United States Patent [19]

Grossman

[11] Patent Number: 4,499,629

[45] Date of Patent: Feb. 19, 1985

[54] DOOR PULL MOUNTING AND LOCKING ASSEMBLY

[75] Inventor: Harvey L. Grossman, Santa Barbara, Calif.

[73] Assignee: Forms & Surfaces, Santa Barbara, Calif.

[21] Appl. No.: 492,337

[22] Filed: May 6, 1983

[51] Int. Cl.[3] ..... B25G 1/06

[52] U.S. Cl. ..... 16/111 R; 16/114 R; 16/DIG. 24; 16/DIG. 40

[58] Field of Search ..... 16/110 R, 111 R, 114 R, 16/121, DIG. 24, DIG. 25, DIG. 40, DIG. 41; 403/201, 245, 264; 292/348, 350; 49/460

[56] References Cited

U.S. PATENT DOCUMENTS

| | | | |
|---|---|---|---|
| 205,941 | 7/1878 | Young | 292/350 |
| 2,294,856 | 9/1942 | West | 16/121 X |
| 2,589,516 | 3/1952 | Stelzer | 16/111 R X |
| 3,222,732 | 12/1965 | Miller | 16/111 R X |

FOREIGN PATENT DOCUMENTS

| | | | |
|---|---|---|---|
| 2712430 | 9/1978 | Fed. Rep. of Germany | 16/110 R |
| 649749 | 12/1928 | France | 292/350 |
| 2507662 | 12/1982 | France | 16/110 R |
| 354190 | 8/1931 | United Kingdom | 292/348 |

*Primary Examiner*—Fred A. Silverberg
*Attorney, Agent, or Firm*—Ralph B. Pastoriza

[57] ABSTRACT

The assembly includes a shaft having its opposite ends threaded in opposite directions. This shaft is passed through a hole in a door to which door pulls are to be mounted. First and second door pulls have oppositely threaded openings for receiving the ends of the shaft. A finished disc member having a central aperture is on the shaft and includes a pin extending into a key way on the shaft so that the shaft can be rotated by rotating the disc to draw the pulls together and thereby sandwich the opening of the door between the pulls. A finished appearance thus results.

3 Claims, 4 Drawing Figures

DOOR PULL MOUNTING AND LOCKING ASSEMBLY

FIELD OF THE INVENTION

This invention relates generally to hardware items for door pulls and more particularly to an improved mounting and locking assembly for securing door pulls to opposite sides of an opening in a door.

BACKGROUND OF THE INVENTION

Door pulls for purposes of simply pulling a door open or pushing it shut such as provided on swingable type doors or glass panel doors are usually secured to the doors by screws or the like in a more or less permanent manner. The appearance of the screw heads is somewhat unsightly. Moreover, the door pulls cannot easily be removed without unscrewing several screws.

In an effort to solve some of the foregoing problems, door pulls have been designed with a necked down portion and a lateral set screw arranged to engage a shaft passing through an opening in the door. While this arrangement avoids unsightly screw heads with the exception of the small head of the set screw, there is a limitation as to the geometry of the pull employed. Moreover, after prolonged use, the set screw does not provide a sufficient holding characteristic to assure that the pulls will remain tightly locked in place.

BRIEF DESCRIPTION OF THE PRESENT INVENTION

With the foregoing considerations in mind, the present invention contemplates an improved mounting and locking assembly for securing door pulls to opposite sides of an opening in a door which overcomes the above-noted disadvantages.

More particularly, in accord with the present invention a shaft has oppositely threaded ends with thread locks. Door pulls in turn are provided with oppositely threaded openings for threadedly receiving the shaft ends after the shaft has been inserted through an opening in the door.

The assembly is completed by a shaft engaging means for rotating the shaft after it has been passed partially through the door and the pulls partially threaded on the extending ends of the shaft. This rotation of the shaft engaging means draws the pulls towards each other to sandwich the door therebetween and lock the pulls to the door.

In the preferred embodiment, the shaft engaging means is in the form of a finished disc having a diameter corresponding to that of the abutting ends of the door pulls so that a finished appearance results. Further, by the use of thread locks on the shaft, a very strong attachment of the shaft to the pulls results and a large locking force can be provided to secure the pulls in place.

BRIEF DESCRIPTION OF THE DRAWINGS

A better understanding of this invention will be had by now referring to the accompanying drawings in which.

DETAILED DESCRIPTION OF THE INVENTION

Figure 1:
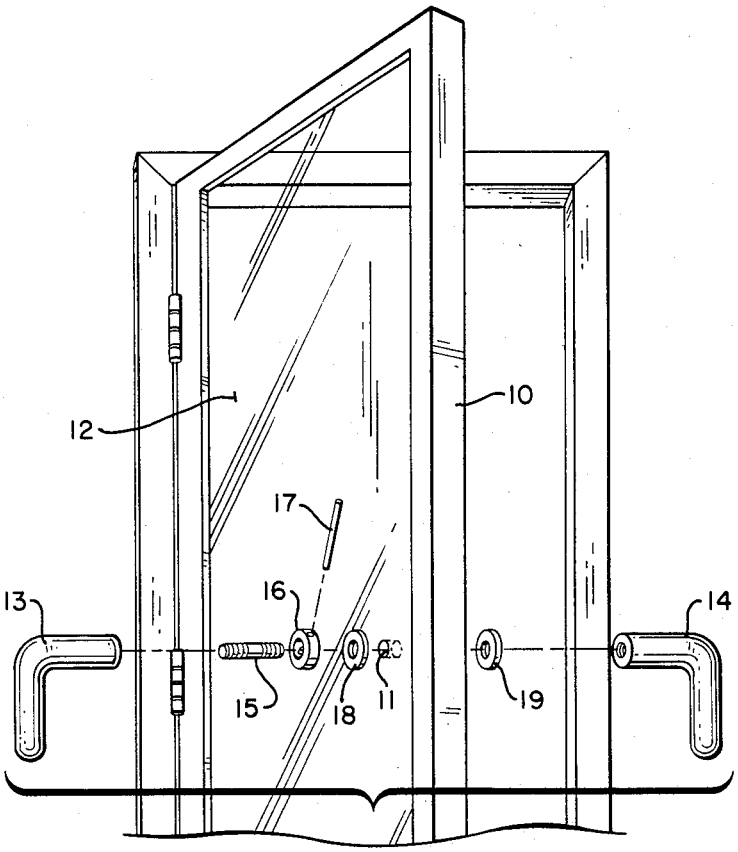
FIG. 1 is a fragmentary perspective view of a typical door on which the mounting and locking assembly of this invention might be used, the various components of the assembly being shown in exploded perspective view.

Referring first to FIG. 1, there is shown a door 10 having an opening 11 to which door pulls are to be secured. In the particular example illustrated, the door 10 has a glass panel 12. However, the invention is applicable to any type of door.

Door pulls or handles 13 and 14 are illustrated in FIG. 1 in exploded view preparatory to being secured to the opening 11 by means of the present invention.

The assembly for mounting and locking the door pulls 13 and 14 in place includes basically a shaft 15 and a locking disc 16 operable by means of an engaging means such as a rod 17 or spanner wrench. If panel 12 is glass as described, there may also be provided small cushioning pads 18 and 19.

Figure 2:
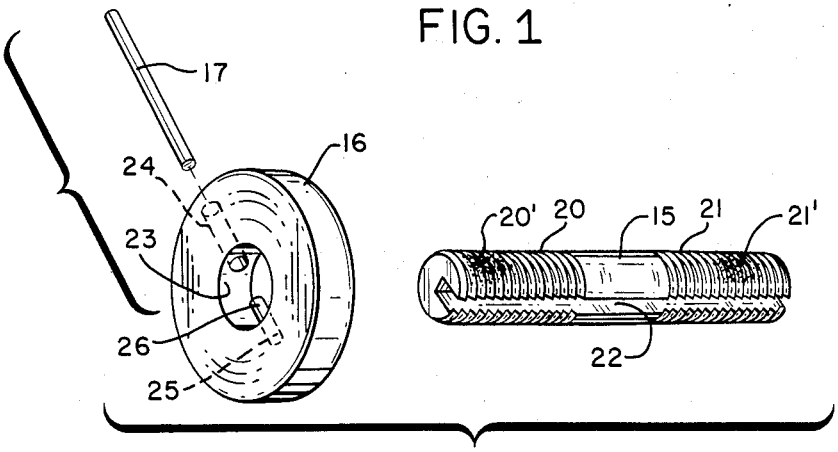
FIG. 2 is an enlarged perspective view of the basic components of the mounting and locking assembly itself.

Referring now to FIG. 2, details of certain components of the invention will be described. As shown, the shaft 15 has right and left hand threads 20 and 21 on its opposite ends, provided with thread locking plastic 20' and 21'. A lateral side portion is relieved to define a longitudinal channel or key way 22 of a given depth.

Cooperating with the shaft 15 is the disc 16 described in FIG. 1. This disc includes a central aperture 23 dimensioned to receive the shaft. Disc 16 further includes a radial bore having a first portion 24 passing from a point on the periphery of the disc into the aperture. This same bore includes a second portion 25 passing into the disc from across the aperture a distance beyond the center of the disc. This second portion 25 terminates short of the diametrically opposite peripheral point on the disc from the point of the first bore portion 24.

The mounting and locking structure is completed by the provision of a pin 26 secured in the second portion of the bore 25 to extend radially into the aperture a given distance less than the depth of the channel 22 for the shaft 15. This pin is arranged to ride in the channel when the shaft 15 is passed through the aperture 23. The disc is thus rotatably locked to the shaft but can still move longitudinally along the shaft.

Figure 3:
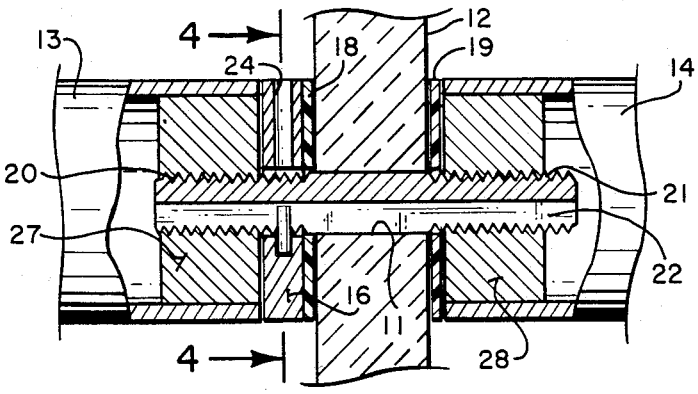
FIG. 3 is a fragmentary cross section of the various components of the assembly after they have been positioned in locking relationship on the door of FIG. 1.

Referring now to FIG. 3, it will be noted that there are provided first means 27 in the first door pull 13 defining a threaded opening for receiving in threaded engagement one end of the shaft 15.

Similarly, there are provided second means 28 in the second door pull 14 defining an oppositely threaded opening for threadedly receiving the opposite end of the shaft 15. The first and second door pulls 13 and 14 are larger than the opening 11 described in FIG. 1. In fact, the diameter of the opposed portions of the pulls or handles 13 and 14 correspond to the diameter of the disc 16, this disc being shown between the first pull 13 on the shaft 15 and one side of the opening in the door glass panel 12. Also shown in the case of glass, are the two pads 18 and 19 described in FIG. 1.

In initially assembling the mount, the shaft is passed through the opening 11 and the second door pull 14 threaded thereto. The disc 16 is then received over the shaft 15 and this end of the shaft then threaded to the first door pull 13.

The rod 17 described in FIG. 1 can then be inserted in the first bore portion 24 and the disc 16 rotated to thereby rotate the shaft and draw the first and second door pulls 13 and 14 towards each other to thereby sandwich the periphery of the opening 11 therebetween. The thread lock plastic assures that the door pulls will be locked in place.

Because of the size of the disc 16, not only can a high turning torque be applied to the shaft 15 by means of the rod 17, but in addition, there results a finished appearance after the rod 17 has been removed. This finished appearance results from the fact that the disc 16 is of the same diameter as the adjacent pull or handle 13 so that it appears to blend in with the pull. Moreover, the small bore opening 24 is almost invisible. However, it should be understood that disc 16 can be of larger diameter.

Figure 4:
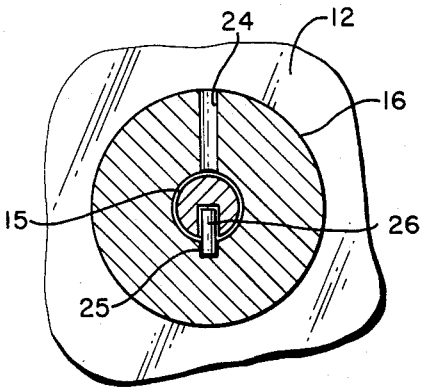
FIG. 4 is a fragmentary cross section taken in the direction of the arrows 4—4 of FIG. 3.

FIG. 4 shows the assembly looking in the direction of the arrows 4—4 of FIG. 3 wherein the pin 26 is clearly shown within the channel 22 of the shaft 15 so that rotation of the disc 16 will clearly rotate the shaft to result in the referred to drawing together of the pulls.

From the foregoing it will also be evident that the pulls can be very easily disassembled by simply reinserting the small rod 17 in the bore portion 24 and rotating the disc 16 in an opposite direction.

While the assembly has been described with respect to a glass door 12 together with cushioning pads 18 and 19, it should be understood that ordinarily there would not be necessary the pads 18 and 19 if a regular wood panel door or metal door were involved. The pads 18 and 19 are provided in the embodiment disclosed to provide a safe seating surface for the peripheral ends of the pulls or handles 13 and 14 against the glass surfaces of the glass panel 12.

It should be understood, accordingly, that the provision of the pads is normally an optional feature and would only preferably be used with glass doors.

I claim:

1. A door pull mounting and locking assembly for securing first and second door pulls to opposite sides of an opening in a door including, in combination:

(a) a shaft having its opposite ends threaded respectively with left and right hand threads, said threads including thread lock means, a lateral side portion of said shaft being relieved to define a longitudinal channel of given depth;

(b) a disc having a central aperture dimensioned to receive said shaft and a radial bore having a first portion passing from a point on the periphery of said disc into said aperture and a second portion passing into said disc from across said aperture a distance beyond the center of the disc, said second portion of said bore terminating short of the diametrically opposite peripheral point on said disc from said first mentioned point;

(c) a pin secured in said second portion of said bore to extend radially into said aperture a given distance less then the depth of said channel and dimensioned to ride in said channel when said shaft is passed through said aperture and thereby rotatably lock said shaft to said disc while permitting longitudinal movement of said disc along said shaft;

(d) first means in said first door pull defining a threaded opening for receiving in threaded engagement one end of said shaft;

(e) second means in said second door pull defining an oppositely threaded opening for threadedly receiving the opposite end of said shaft, said first and second door pulls being larger than said opening whereby said opposite end can be passed through said opening and said second door pull threaded thereto, said disc being received over said one end of said shaft and said first door pull then being threaded onto said one end; and (f) an engaging means receivable in said first portion of said bore in said disc for rotating said disc and thereby said shaft in a direction to draw said first and second door pulls towards each other to thereby sandwich the periphery of the door opening therebetween and lock the door pulls to the door, said engaging means then being removed from said first portion of said bore to leave a finished appearance.

2. A door pull mounting and locking assembly according to claim 1, in which said door opening passes through a glass panel constituting part of said door, said assembly including cushioning pads on said shaft between said door pulls and the peripheries of the door opening against which the door pulls bear.

3. A door pull mounting and locking assembly according to claim 1, in which the diameter of said disc corresponds to the diameter of the adjacent periphery of the first pull so that a finished appearance results.

* * * * *